US011346110B2

(12) United States Patent
Timmons

(10) Patent No.: US 11,346,110 B2
(45) **Date of Patent: *May 31, 2022**

(54) RAKING RAIL PANEL AND BRACKET SYSTEM AND METHOD

(71) Applicant: Fortress Iron, LP, Garland, TX (US)

(72) Inventor: Evan Timmons, Arlington, TX (US)

(73) Assignee: Fortress Iron, LP, Garland, TX (US)

( * ) Notice: Subject to any disclaimer, the term of this patent is extended or adjusted under 35 U.S.C. 154(b) by 162 days.

This patent is subject to a terminal disclaimer.

(21) Appl. No.: 16/722,309

(22) Filed: Dec. 20, 2019

(65) Prior Publication Data

US 2020/0123782 A1 Apr. 23, 2020

Related U.S. Application Data

(63) Continuation of application No. 15/790,814, filed on Oct. 23, 2017, now Pat. No. 10,513,854.

(51) Int. Cl.
*E04F 11/18* (2006.01)

(52) U.S. Cl.
CPC ..... *E04F 11/1834* (2013.01); *E04F 11/1844* (2013.01); *E04F 2011/1819* (2013.01)

(58) Field of Classification Search
CPC ..... E04F 11/0834; E04F 11/1844; E04F 2011/1819
USPC ..... 256/24, 59, 60, 65.01, 65.02, 65.03, 256/65.04, 67, 73
See application file for complete search history.

(56) References Cited

U.S. PATENT DOCUMENTS

| | | | | |
|---|---|---|---|---|
| 2,715,513 | A * | 8/1955 | Kools | E04F 11/1834 256/21 |
| 3,767,236 | A * | 10/1973 | Horgan, Jr. | E04F 11/1817 403/73 |
| 3,960,367 | A | 6/1976 | Rogers et al. | |
| 5,026,028 | A | 6/1991 | Ooi et al. | |
| 5,547,169 | A | 8/1996 | Russell | |
| 6,053,481 | A | 4/2000 | Scheide | |
| 6,802,496 | B1 | 10/2004 | Preta | |
| 8,899,555 | B2 | 12/2014 | Sherstad | |
| 9,322,180 | B2 | 4/2016 | Burt et al. | |

(Continued)

FOREIGN PATENT DOCUMENTS

JP 05-187114 7/1993

OTHER PUBLICATIONS

"Fe\up3 26 \cf1\up0 Iron Railing Simplified," Fortress Railing Products—Residential, Nov. 17, 2016, 34 pages<I>.

(Continued)

*Primary Examiner* — Daniel J Wiley
(74) *Attorney, Agent, or Firm* — Foley & Lardner LLP; John J. May

(57) ABSTRACT

A raking rail panel system includes a raking rail panel that is supported by four pivotable bracket assemblies. Each pivotable bracket assembly includes a rail support bracket that is hinged to a post bracket. Each post bracket is configured to be coupled to a vertical support post. The post brackets each include a gap filling portion that extends from a mounting face of the vertical support posts. The gap filling portions are sized to either fill a long or a short gap between an end baluster and the vertical support post. The four pivotable bracket assemblies facilitate drop-in installation of the rail panel pivoted in a range of rake angles.

16 Claims, 11 Drawing Sheets

(56) References Cited

U.S. PATENT DOCUMENTS

| | | | |
|---|---|---|---|
| 9,500,000 | B2 | 11/2016 | McCarty et al. |
| 2006/0033093 | A1 | 2/2006 | Lo |
| 2009/0179183 | A1 | 7/2009 | Ferris et al. |
| 2014/0252290 | A1 | 9/2014 | Lachenberg |

OTHER PUBLICATIONS

"RDI Metal Works Excalibur\up3 (R)\up0 ," Installation Instructions, www.rdirail.com, Mar. 2017, 17 pages.
"RDI Original Rail," Instructions, www.rdirail.com, Mar. 2017, 32 pages.
"RDI Titan Pro Rail," Instructions, www.rdirail.com, Mar. 2017, 28 pages.
"Tuscany Series & Montego Series (Style C10, C101 and C20) Installation Instructions," Westbury Aluminum Railing, Digger Specialities, Inc., www.westburyrailing.com, May 30, 2017, 2 pages.
Installation Guide, Aluminum Solutions Fairway, Rail Systems #909915, http://www.absolutedist.com/images/AlumRailing_Install_Guide_Pack.pdf, printed 2011, 10 pages.
International Search Report and Written Opinion for International Application No. PCT/US2018/056843, dated Feb. 12, 2019, 10 pages.

* cited by examiner

RAKING RAIL PANEL AND BRACKET SYSTEM AND METHOD

CROSS-REFERENCE TO RELATED APPLICATIONS

This application is a continuation of and claims the benefit of U.S. patent application Ser. No. 15/790,814 entitled "Raking Rail Panel and Bracket System and Method," filed on Oct. 23, 2017, and naming Evan Timmons as inventor, the contents of which are hereby incorporated herein by reference.

TECHNICAL FIELD

The present disclosure relates to construction materials, and more particularly to a rail panel and bracket system that is easily installed in a range of rake angles.

BACKGROUND

Conventional raked or raking (sometimes referred to as racked or racking) rail panels are difficult to install and often require more than one person. According to some conventional raking rail panels, the pivot point of the rail bracket is not aligned with the pivot point of the balusters. This frustrates angle adjustability for a pre-assembled rail panel because the angle of the brackets and the angle of the rail panel are not simultaneously adjustable. Thus, precise measuring and prepositioning is required to ensure that the installation properly accounts for a slope of the stairway (i.e. rake angle).

Reference is made to FIG. 1A, which illustrates installation of a conventional raking rail panel 10 on a stairway 12. The rail panel 10 includes a top rail 14 and a bottom rail 16 separated by balusters 18. The balusters 18 are collectively pivotable with respect to the top rail 14 and the bottom rail 16. It is important for a professional looking installation that the rail panel appear to be centered within the elevated vertical support post 20*a* and the descended vertical support post 20*b*. Thus, the horizontal distance 22 from the elevated vertical support post 20*a* to an adjacent baluster 18 should equal the horizontal distance 24 from the descended vertical support post 20*b* to an adjacent baluster 18.

It is also important that the balusters are parallel to the vertical support posts. The geometry that arises when raked top and bottom rails intersect a support post complicates installation because the top and bottom rails are cut with unequal lengths of mountable extension portions as measured from an adjacent baluster. To accurately measure such unequal lengths, it is often necessary to preposition the panel on a set of support blocks 26 and mark the top and bottom rails for cutting. Prepositioning the panel is cumbersome and may even result in damage to the rail panel and also possibly to the vertical support posts.

FIG. 1B shows the raking rail panel in a straight or square configuration with cutting marks that arise when the prepositioned panel is marked. Cutting marks 27, 29 are marked closer to the end baluster 18 on the cut rail panel; cutting marks 23, 25 are marked further away from the end baluster 18 on the cut rail panel. FIG. 1C shows the cut panel 30 in a raked configuration. The panel is cut such that mountable extension lengths 36, 38 of the top and bottom rails 14, 16 are less than mountable extension lengths 32, 34 of the top and bottom rails 14, 16. The extension lengths will be different for railing installations at different rake angles. It can be observed from FIG. 1C that if the top and bottom rails were cut such that the mountable extension lengths 32, 34, 36, 38 were all equal, a gap between the end balusters 18 and the vertical support posts 20*a*, 20*b* would need to be filled.

An alternative that avoids prepositioning of a preassembled rail panel requires prepositioning of the top and bottom rails. Once the top and bottom rails are prepositioned, measured, marked, and cut, as described above, the balusters may be installed in a vertical orientation between the top and bottom rails.

SUMMARY

Embodiments of the present disclosure include a raking rail panel system. The system includes a raking rail panel supported by four pivotable bracket assemblies. Each pivotable bracket assembly includes a rail support bracket that is hinged to a post bracket. Each post bracket is configured to be coupled to a vertical support post. The post brackets each include a gap filling portion that extends from a mounting face of the vertical support posts. The gap filling portions are sized to either fill a long or a short gap between an end baluster and the vertical support post. The four pivotable bracket assemblies facilitate drop-in installation of the rail panel pivoted in a range of rake angles.

A method for installing a raking rail panel includes positioning a first pivotable bracket assembly on a face of an elevated vertical support post. A second pivotable bracket assembly is positioned on a descended vertical support post. A distance between the first and second pivotable bracket assemblies is measured, and then marked on a top rail and a bottom rail. The top and bottom rails are cut to have equal mounting extension lengths. The cut bottom rail is dropped in to the first and second pivotable bracket assemblies.

Technical advantages of embodiments of the raking rail panel system and method according to the teachings of the present disclosure include accommodation of a range of rake angles by the pivotable bracket assemblies. The bracket assemblies close a gap that would otherwise result if the top and bottom rails were cut to have four equal extension lengths. In addition, measuring and marking is performed without requiring prepositioning of the uncut raking rail panel, so one person can easily install a raking rail panel on a staircase.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

Figure 1A:
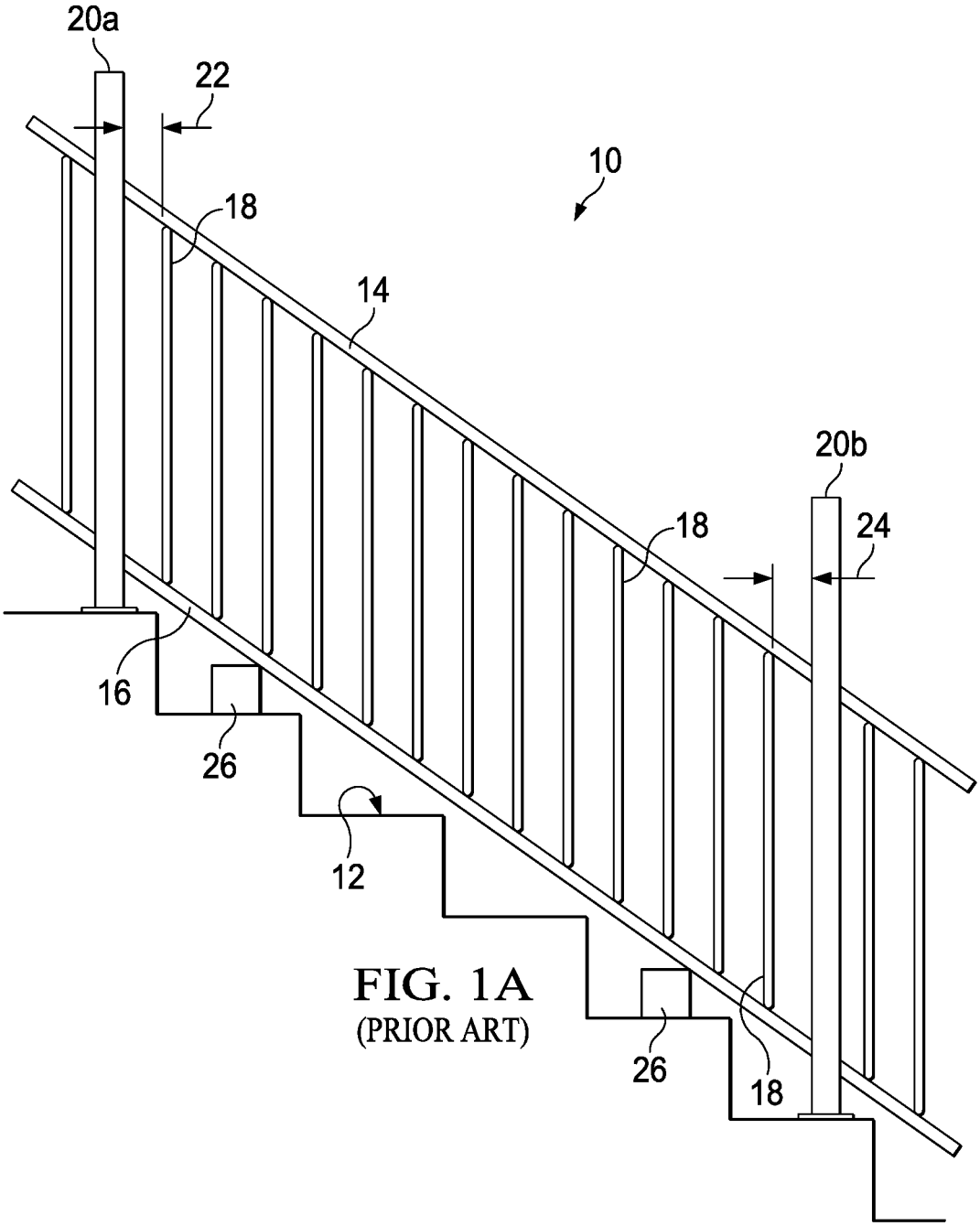
FIG. 1A (PRIOR ART)
FIG. 1A-1C illustrate steps of an installation of a prior art raking rail panel.
Figure 1B:
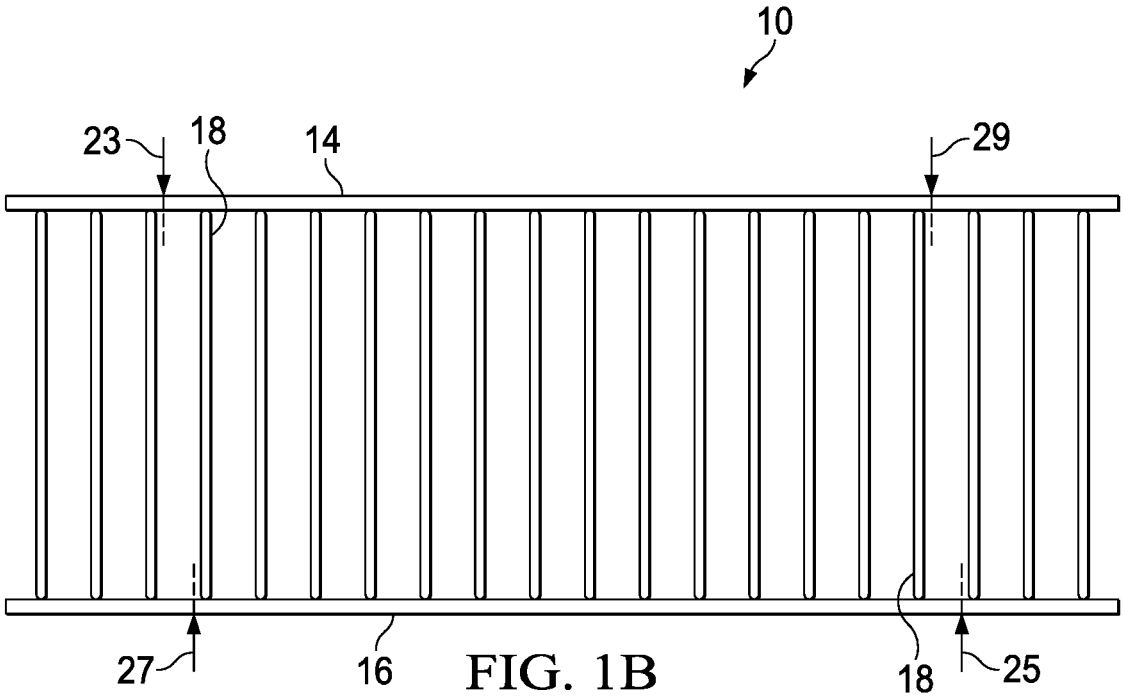
FIG. 1B (PRIOR ART)
Figure 1C:
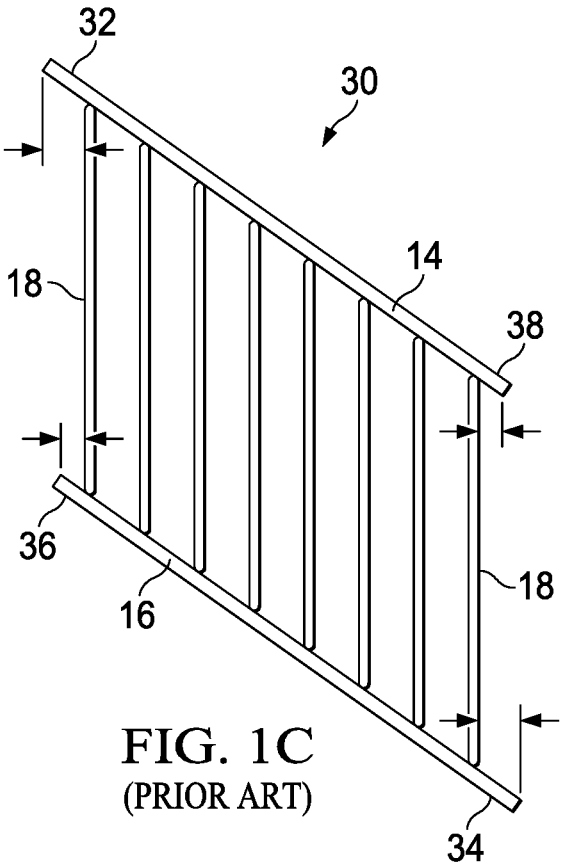
FIG. 1C (PRIOR ART)
Figure 2:
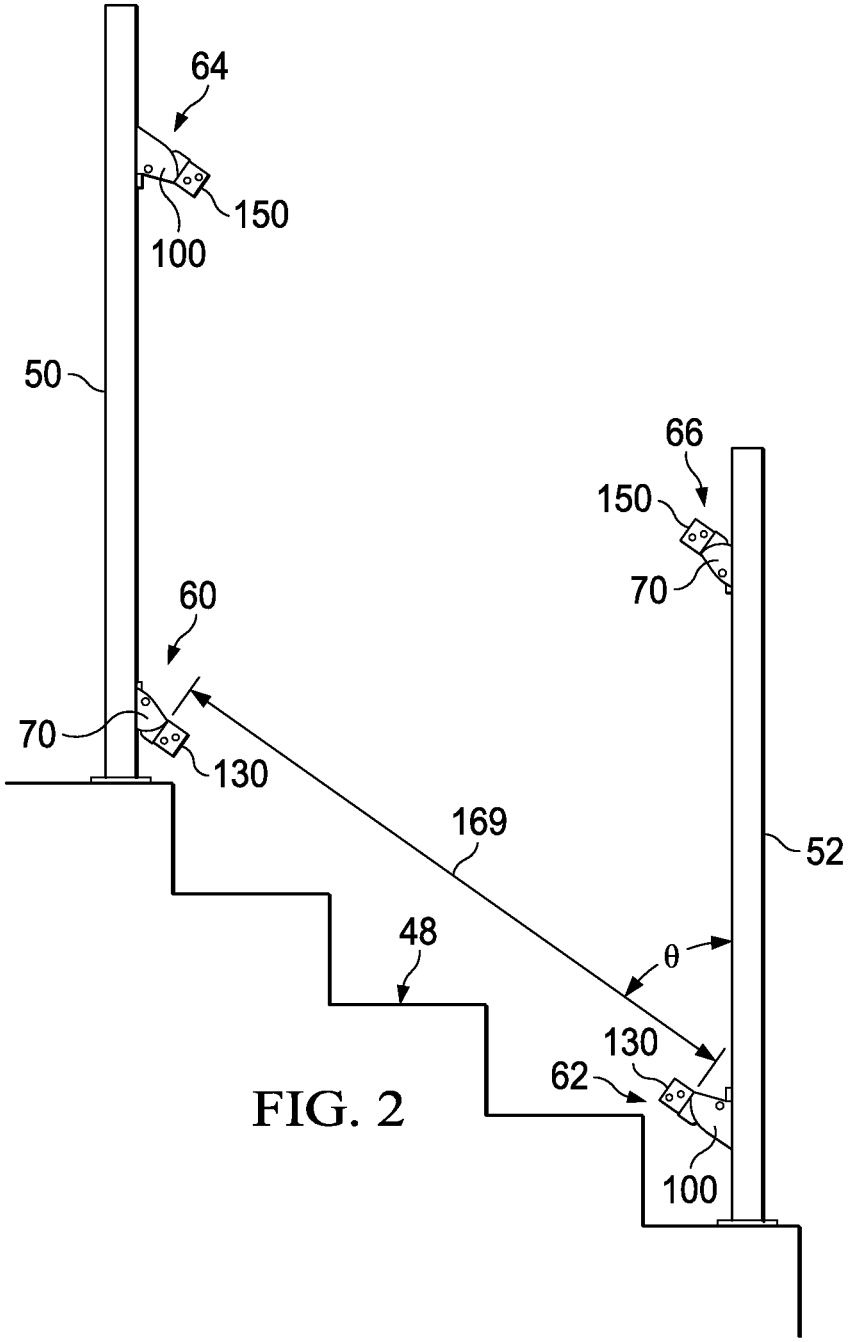
FIG. 2 illustrates early steps in an installation of a raking rail panel and gap filling pivotable bracket assemblies according to the teachings of the present disclosure.
Figure 9:
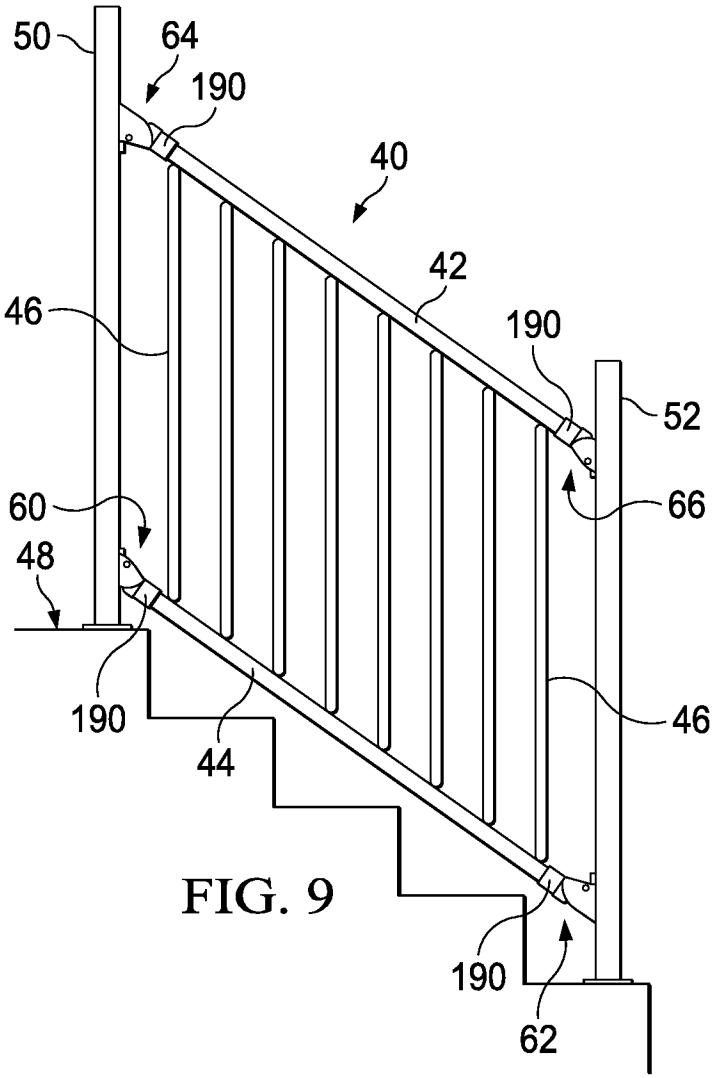
FIG. 9 illustrates a raking rail panel installed in pivotable bracket assemblies according to the teachings of the present disclosure.

FIG. 2 illustrates a step in the installation of a raking rail panel 40 (see FIG. 9). With reference to FIG. 9, the raking rail panel 40 is preassembled and includes a top rail 42 and a bottom rail 44 vertically spaced apart from the top rail 42. Balusters 46, also known as uprights or pickets, extend between the top and bottom rails 42, 44. The balusters 46 are horizontally spaced apart and collectively form the barrier portion of the rail panel 10. Each of the balusters 46 is pivotally coupled to the top and bottom rails 42, 44. Such pivotal coupling allows the top and bottom rails 42, 44 to be angled to correspond to an angle of a staircase 48, while the balusters 46 pivot to stay vertical.

The rail panel 40 is configured for easy installation in a raked configuration according to the teachings of the present disclosure. According to one embodiment, the raked rail panel 40 is installed as a rail barrier for a stairway 48. The raked rail panel 40 may be installed in sloping configurations common to stairways. As described further below, the installer will cut the preassembled rail panel 40 to the precise length required for the preassembled rail panel 40 to fit and be supported by an elevated vertical support post 50 and a descended vertical support post 52. More specifically, the pivotable bracket assemblies according to the teachings of the present disclosure support drop-in installation of the cut preassembled rail panel 40.

The pivotable bracket assemblies 60, 62, 64, 66 support a drop in installation of the cut raking rail panel 40. This is a significant advantage for the installer as it allows the installer set the vertical post members, install the brackets, and then drop the railing, panel or other structure, for example a railing where cables form the primary barrier, into place. This also supports installation with the use of fewer personnel and with an easier and quicker installation and assembly time.

The preassembled rail panel 40 may be any suitable length. For example, in one embodiment the preassembled rail panel is approximately six feet in length, and in an alternate embodiment, the preassembled rail panel is approximately eight feet in length.

As explained in further detail below, an installer may measure a length of the preassembled rail panel that corresponds to a distance between faces of vertical support posts that are attached to the stairway 48, the top and bottom rails 42, 44 are cut to the measured length, and the cut, preassembled rail panel 40 is then dropped into pivotable bracket assemblies that have been previously attached to the vertical support posts 50, 52. A mountable extension of the top rail 42 extends the same length from an adjacent baluster 46 as a mountable extension of a bottom rail 44.

Referring back to FIG. 2, the descended vertical support post 52 is secured to a lower stair of the stairway 48, and a second, elevated vertical support post 50 is secured to an upper stair of the stairway 48 that is elevated from the lower stair. A base of each support post 50, 52 may be attached to a wooden stair that has been blocked between rim joists. Hex head bolts are received through preformed holes formed in a flange at the base of the post to secure the post to the stairway 48. The posts may be of any suitable metal, for example galvanized steel or aluminum. According to an alternate embodiment, the posts may be made of wood or a durable polymer material.

A pair of pivotable bracket assemblies is mounted to each vertical support post 50, 52. The four pivotable bracket assemblies include an elevated, bottom assembly 60, a descended bottom assembly 62, an elevated, top assembly 64, and a descended, top assembly 66. The pivotable bracket assemblies 60, 62, 64, 66 serve multiple functions. The pivotable bracket assemblies support the top and bottom rails 42, 44. The pivotable bracket assemblies also close or otherwise fill a gap between ends of the top and bottom rails 42, 44 and the mounting surface of the vertical support posts 50, 52. In addition, the pivotable bracket assemblies are pivotable to accommodate a range of rake angles θ of the rail panel 40. For example, the raking rail panel 40 is pivotable to accommodate rake angles θ in a range of 0-45 degrees. The pivotable bracket assemblies are pivotable to accommodate rake angles θ in a range of 29-40 degrees measured from horizontal, which allows installation on stairways with gradual or steeper slopes.

According to the teachings of the present disclosure, each pivotable bracket assembly includes two components coupled together by a hinge. Manufacturing of the pivotable brackets 60, 62, 64, 66 is simplified because the eight components are formed from four separate parts that are assembled in different configurations, as described in further detail below. Thus, the system 10 is manufactured with four separate bracket parts, with two of each provided in a kit along with instructions to install the raking rail panel.

In an early step in the installation of the raked rail panel 40, a long straight two-by-four piece of wood is positioned on the stairway such that its wide face contacts the upper most edge of each stair. This establishes the slope of the stairway. Marks are made on interior faces of the vertical support posts 50, 52 to mark the location of the lower pivotable bracket assemblies 60, 62. The two-by-four also mimics the location of the position of the installed bottom rail 44.

Figure 3A:
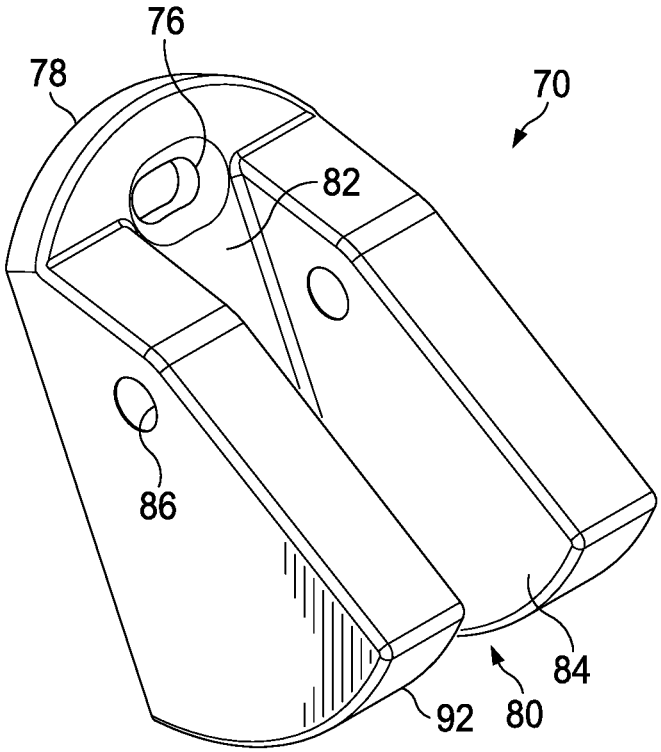
FIGS. 3A-3B are an isometric view and an elevation view of a short post bracket.
Figure 3B:
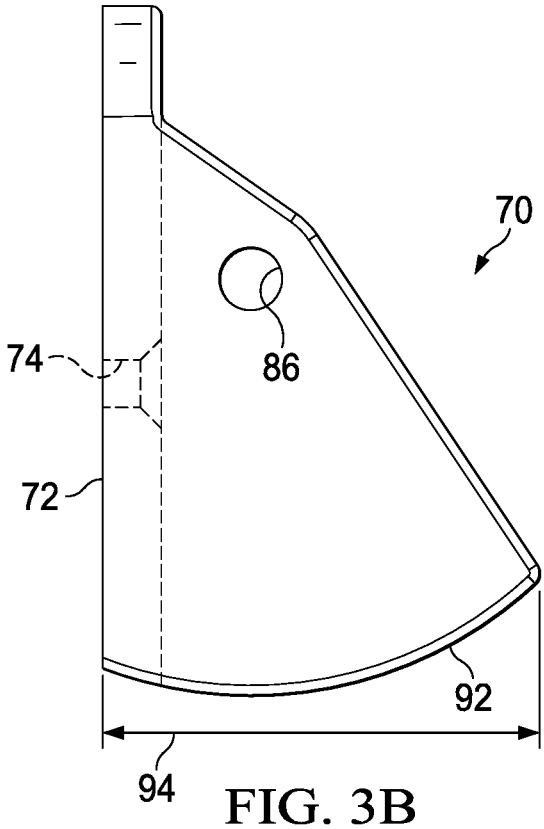

On the elevated vertical post 50 drill locations associated with a short gap filling post bracket 70 are marked for the pivotable bracket assembly 60. Reference is made to FIGS. 3A and 3B, which are an isometric view and a side, elevation view of the gap filling post bracket 70. The gap filling post bracket 70 may be referred to a short post bracket because it is shorter to fill a shorter gap distance between the face of the elevated vertical support post 50 and the end of the bottom rail 44, unlike a extended gap filling post bracket 100, which fills a larger gap distance between the end of the top rail 42 and the face of the elevated vertical support post 50.

The short post bracket 70 includes a generally flat rear mounting surface 72 that contacts the mounting face of the vertical support post 50, 52. A center through hole 74 receives a fastener to secure the short post bracket 70 to the vertical support post 50, 52. The center through hole 74 is countersunk to ensure that the head of the mounting screw is flush. The flush head of the mounting screw does not interfere with the arm of the rail support bracket.

A second fastener is received through an outer slot 76. The slot 76 allows adjustment of an angle of the short post bracket 70 to ensure it is vertical and aligned with the vertical support post 50, 52, in the event the holes were not drilled in the vertical support post in vertical alignment. The slot 76 is formed through an arcuate flange 78 or tab. A body of the short pivotable bracket 70 defines a pivot arm receiving cavity 80. The arm receiving cavity 80 is defined by a floor surface 82 and a pair of sidewalls 84 disposed on opposite sides of the floor surface 82. The arm receiving cavity 80 receives an arm portion of a rail support bracket (shown and described below with respect to FIGS. 5 and 6) and allows the rail support bracket to pivot in one angular direction, but pivoting in the opposite angular direction is constrained by the floor surface 82.

A hinge hole 86 extends through the body. The hinge hole 86 receives a barrel 88 at one end and a screw 90 is received in the other end of the hinge hole 86 and threadedly engages the barrel 88 (see FIGS. 7A and 7D). The barrel 88 is a bearing surface that supports pivoting of the rail support bracket with respect to the fixed short gap filling post bracket 70. The body also includes an arcuate surface 92 that corresponds to an arcuate surface of the rail support bracket, as described with respect to FIGS. 5 and 6. A length 94 that the body extends from the rear mounting face 72 may be in a range of 1-2 inches, for example approximately 1.77 inches. A height of the mounting face 72 may be in a range of 1-4 inches, for example approximately 2.68 inches. These dimensions ensure that the short gap filling post bracket 70 fills the short gap between a face of the vertical support post 50, 52 and the ends of the top and bottom rails 42, 44.

The short gap filling post bracket 70 is formed by die casting metal, such as aluminum or steel, and machining the die cast aluminum or steel. According to one embodiment, the short gap filling post bracket 70 is formed by die casting an aluminum alloy, for example ADC 12, and machining the cast structure to form the illustrated features. Alternatively, the short gap filling post bracket 70 may be formed by molding a durable polymeric material.

Figure 4A:
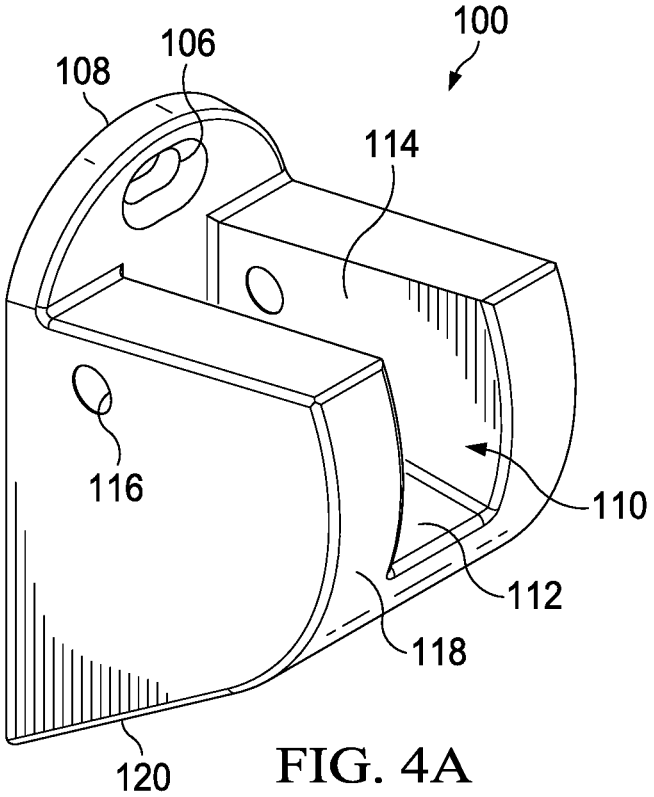
FIGS. 4A-4B are an isometric view and an elevation view of an extended post bracket.
Figure 4B:
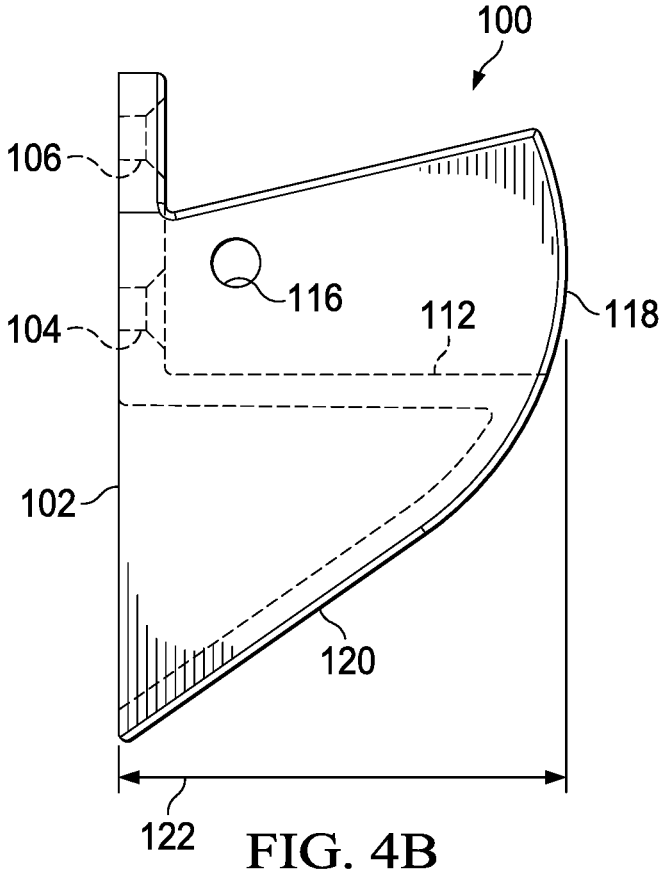

Returning briefly to FIG. 2, at the descended vertical support post 52 drill locations associated with an extended or long gap filling post bracket 100 are marked. Reference is made to FIGS. 4A and 4B, which are an isometric view and a side, elevation view of the extended gap filling post bracket 100. The gap filling post bracket 100 may be referred to a long post bracket because it is longer to fill a larger gap distance between the face of the lower vertical support post 52 and the end of the bottom rail 44, unlike the short gap filling post bracket 70, which fills the shorter gap distance.

The extended post bracket 100 includes a generally flat rear mounting surface 102 that contacts the mounting face of the vertical support post 50, 52. A center through hole 104 receives a fastener to secure the extended post bracket 100 to the vertical support post 50, 52. The center through hole 104 is countersunk to ensure that the head of the mounting screw is flush. The flush head of the mounting screw does not interfere with the arm of the rail support bracket. A second fastener is received through an outer slot 106 formed in an arcuate flange 108 or alternatively a tab. The slot 106 allows adjustment of an angle of the extended post bracket 100 to ensure it is vertical and aligned with the vertical support post 50, 52, in the event the holes were not drilled in the vertical support post in vertical alignment. A body of the extended pivotable bracket 100 defines a pivot arm receiving cavity 110. The arm receiving cavity 110 is defined by a floor surface 112 and a pair of sidewalls 114 disposed on opposite sides of the floor surface 112. The arm receiving cavity 110 receives the arm portion of the rail support bracket (described and shown below with respect to FIGS. 5 and 6) and allows the rail support bracket to pivot in one angular direction, but pivoting in the opposite angular direction is constrained by the floor surface 112. A hinge hole 116 extends through the body. The hinge hole 116 receives a barrel 88 at one end and a screw 90 is received in the other end of the hinge hole 116 and threadedly engages the barrel 88 (see FIGS. 7B and 7C). The barrel 88 is a bearing surface that supports pivoting of the rail support bracket with respect to the fixed extended gap filling post bracket 100.

Figure 5:
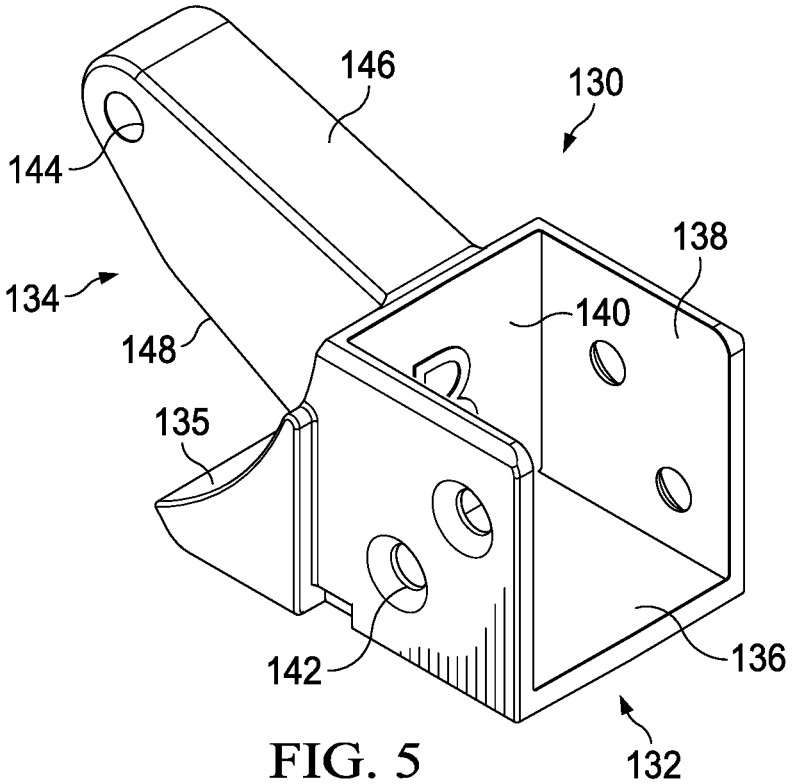
FIG. 5 is an isometric view of a bottom rail support bracket.
Figure 6:
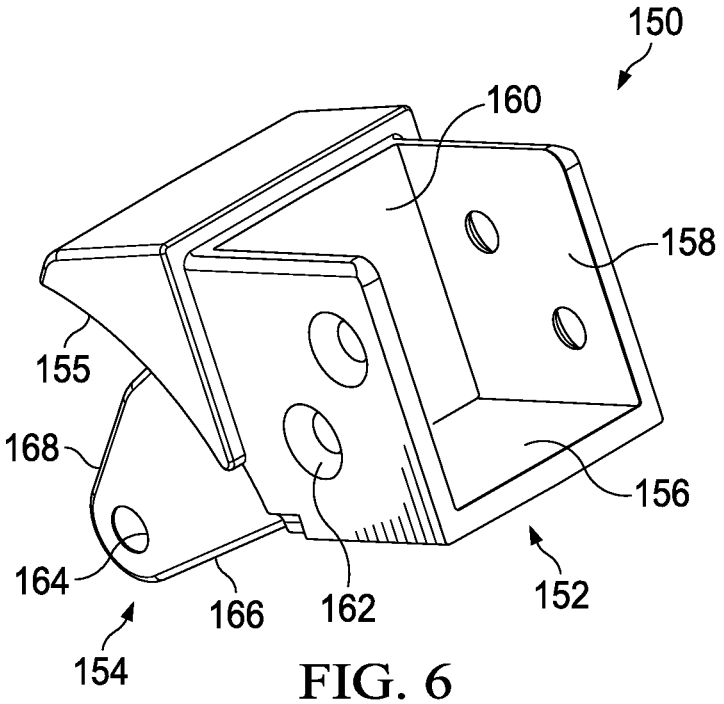
FIG. 6 is an isometric view of a top rail support bracket.

The body also includes an arcuate surface 118 that corresponds to an arcuate surface of the rail support bracket, as described with respect to FIGS. 5 and 6. Referring back to FIGS. 4A and 4B, the arcuate surface 118 transitions to a slanted surface 120 that is delimited by the rear mounting surface 102. The slanted surface 120 is generally aligned with a top surface of either the top or bottom rail 42, 44 in multiple rake angles when the raking rail panel is held by the pivotable bracket assemblies. A length 122 that the body extends from the rear mounting face 102 may be in a range of 2-3 inches, for example approximately 2.28 inches. A height of the mounting face may be in a range of 2-5 inches, for example approximately 3.41 inches. These dimensions ensure that the extended gap filling post bracket 100 fills the larger gap between a face of the vertical support post 50, 52 and the ends of the top and bottom rails 42, 44.

The extended gap filling post bracket 100 is formed by die casting metal, such as aluminum or steel, and machining the die cast aluminum or steel. According to one embodiment, the extended gap filling post bracket 100 is formed by die casting an aluminum alloy, for example ADC 12, and machining the cast structure to form the illustrated features. Alternatively, extended gap filling post bracket 100 may be formed by molding a durable polymeric material.

Referring again to FIG. 2, drill locations corresponding to the center through hole 104 and outer slot 106 of the extended post bracket 100 are marked on the elevated vertical support post 50 a predetermined distance above the drill locations of the short post bracket 70. The extended post bracket is inverted such that the slot 106 is disposed closest to the lower/short post bracket 70. According to one embodiment, the mark for the center through hole 104 corresponds to a height of the preassembled raking rail panel 40. According to one embodiment, the height of the preassembled rail panel 40 is approximately 29.5 inches. According to an alternate embodiment, the preassembled raking rail panel 40 has a height of 35.5 inches. This disclosure contemplates any suitable height rail panel 40. Regardless of the height of the preassembled raking rail panel 40, if the height is known, the marking for the locations of the upper pivotable post brackets 64, 66 can be made using known distances based on the known height of the raking rail panel. According to some embodiments, a template with holes marked at the proper locations may be provided with the raking rail panel 40 and the pivotable bracket assemblies 60, 62, 64, 66. According to an alternate embodiment, the distances may be measured by the installer but prepositioning the uncut rail panel is not required. The ability to measure distances between top and bottom rail brackets facilitated by the pivotable bracket assemblies according to the teachings of the present disclosure represents an improvement over conventional brackets because with conventional raking rail panel installations using conventional brackets, the positioning of a top bracket with respect to a bottom bracket varies, at least slightly, depending on the rake angle.

Reference is made to FIG. 5, which is an isometric view of a rail support bracket 130 configured to support the lower rail 44 of the preassembled rail panel 40. The lower rail support bracket 130 includes a rail support cup 132 sized to receive an end of the bottom rail 44. A pivot arm 134 extends from a rear of the cup 132. A portion supporting an arcuate surface 135 also extends from the rear of the cup 132.

The bottom rail support bracket 130 is formed by die casting metal, such as aluminum or steel, and machining the die cast aluminum or steel. According to one embodiment, the bottom rail support bracket 130 is formed by die casting an aluminum alloy, for example ADC 12, and machining the cast structure to form the illustrated features. Alternatively, the bottom rail support bracket 130 may be formed by molding a durable polymeric material.

The bottom rail support bracket 130 includes four adjacent sides of a cube-like structure with openings in the top and the front of the cube-like structure to allow an end of the bottom rail 44 to be dropped into the cup 132. The four adjacent sides of the cup 132 comprise a bottom wall or floor 136, a pair of opposed side walls 138, and a rear/back wall 140. The pair of opposed side walls 138 and back wall 140 extend perpendicularly from the bottom wall 136.

The bottom wall 136 provides a primary support for receiving the end of the bottom rail 44. The weight of the bottom rail 44 and any downward force on the bottom rail 44 is opposed, at least in part, by the bottom wall 136.

The side walls 138 provide for lateral retention of the received end of the bottom rail 44. At least one of the side walls 138, and in the illustrated embodiment both side walls 138, includes at least one countersunk hole 142, for example two countersunk holes 142. The holes 142 support insertion of a mounting screw through the hole 142 for attachment to a side of the bottom rail 44. This attachment may be made into and through the side of the bottom rail 44 member (using an opening therein) or alternatively against the side surface of the bottom rail 44 (such as with the use of a set screw or self-tapping screw). Thus, using the holes 142 and associated mounting screws, the side walls 138 further function to restrain longitudinal movement of the received bottom rail 44 (i.e., removal of the end of the bottom rail from the cup 132). The bottom rail 44 may be sufficiently secured within the cup 132 with a fastener received through only one countersunk hole per side wall 138.

The pivot arm 134 extends from the cup at a non-perpendicular angle. At a distal end of the arm 134, a through hole 144 is formed. The through hole 144 receives the barrel 88 of the hinge assembly when the rail support bracket 130 is coupled to the short or extended post bracket 70, 100. The pivot arm 134 includes a top surface 146 and a bottom surface 148. When the bottom surface 148 contacts the floor surface 82, 112 defining the cavity 80, 110 of the post bracket 70, 100 the top surface 146 is generally flush with the post bracket 70, 100. The pivot arm 134 is configured to pivot away from contact with the floor surface 82, 112 and away from flush with the post bracket 70, 100 to accommodate different angles of the slope of the top and bottom rails 42, 44, which corresponds to the slope of the stairway 48. According to some embodiments, the pivotable brackets 60, 62, 64, 66 and preassembled raking rail panel 40 adjusts to accommodate an angle between 29-40 degrees from horizontal.

The portion that includes the arcuate surface 135 is disposed below the pivot arm 134 and proximate the floor 136 of the cup 132. The arcuate surface 135 corresponds to the arcuate surfaces 92, 118 of both the short and the extended post brackets 70, 100.

Reference is made to FIG. 6, which illustrates a rail support bracket 150 configured to support an upper or top rail 42 of the preassembled rail panel 40. The top rail support bracket 150 includes a rail support cup 152 sized to receive an end of the top rail 42. A pivot arm 154 extends from a rear of the cup 152. A portion supporting an arcuate surface 155 also extends from the rear of the cup 152.

The top rail support bracket 150 is formed by die casting metal, such as aluminum or steel, and machining the die cast aluminum or steel. According to one embodiment, the top rail support bracket 150 is formed by die casting an aluminum alloy, for example ADC 12, and machining the cast structure to form the illustrated features. Alternatively, the top rail support bracket 150 may be formed by molding a durable polymeric material.

The top rail support bracket 150 includes four adjacent sides of a cube-like structure with openings in the top and the front of the cube-like structure with openings in the top and the front of the cube-like structure to allow an end of the top rail 42 to be dropped into the cup 152. The four adjacent sides of the cup 152 comprise a bottom wall or floor 156, a pair of opposed side walls 158, and a rear/back wall 160. The pair of opposed side walls 158 and back wall 160 extend perpendicularly from the bottom wall 156.

The bottom wall 156 provides a primary support for receiving the end of the top rail 42. The weight of the top rail 42 and any downward force on the top rail 42 is opposed, at least in part, by the bottom wall 156.

The side walls 158 provide for lateral retention of the received end of the top rail 42. At least one of the side walls 158, and in the illustrated embodiment both side walls 158, includes at least one countersunk hole 162, for example two countersunk holes 162. The holes 162 support insertion of a mounting screw through the hole 162 for attachment to a side of the top rail 42. This attachment may be made into and through the side of the top rail 42 (using an opening therein) or alternatively against the side surface of the top rail 42 (such as with the use of a set screw or self-tapping screw). Thus, using the holes 162 and associated mounting screws, the side walls 158 further function to restrain longitudinal movement of the received top rail 42 (i.e., removal of the end of the bottom rail from the cup 152). The top rail 42 may be sufficiently secured within the cup 152 with a fastener received through only one countersunk hole per side wall 158.

The pivot arm 154 extends from the cup 152 at an angle. At a distal end of the arm 154, a through hole 164 is formed. The through hole 164 receives the barrel 88 of the hinge assembly when the rail support bracket 150 is coupled to the short or extended post bracket 70, 100. The pivot arm 154 includes a top surface 166 and a bottom surface 168. When the bottom surface 168 contacts the floor surface 82, 112 defining the cavity 80, 114 of the post bracket 70, 100 the top surface 166 is generally flush with the post bracket 70, 100. The pivot arm 154 is configured to pivot away from contact with the floor surface 82, 112 and away from flush with the post bracket 70, 100 to accommodate different angles of the slope of the top and bottom rails 42, 44, which corresponds to the slope of the stairway 48. According to some embodiments, the pivotable brackets 60, 62, 64, 66 and preassembled raking rail panel 40 adjusts to accommodate an angle between 29-40 degrees from horizontal.

The top rail support bracket 150 is similar to the bottom rail support bracket 130 with the exception of the location of a lever arm 154 and the hinge hole 164 formed in the lever arm 154 with respect to a floor surface 156 of the cup 152. The pivot arm 154 is located below the arcuate surface 155 proximate the floor 156 of the cup 152.

Although the top rail support bracket 150 is formed from a different casting than the bottom rail support bracket 130, the bottom rail support bracket 130 is similar to the top rail support bracket 150 with the exception of the location of the respective floor surfaces 136, 156. Thus, in manufacturing, the bottom rail support bracket 130 can be transformed into the top rail support bracket by relocating the floor surface from a bottom portion of the cube-like structure to the top portion of the cube like structure.

The rail support brackets may be stamped or otherwise marked with an indicator, such as a letter "B," indicating that the bracket is to be used to support the bottom rail 44 or a "T" to indicate that the bracket is to be used to support the top rail. Similarly, an "S" may be stamped or otherwise marked in the short post bracket 70, and an "L" may be stamped or otherwise marked in the extended (i.e. long) post bracket 100.

Figure 7A:
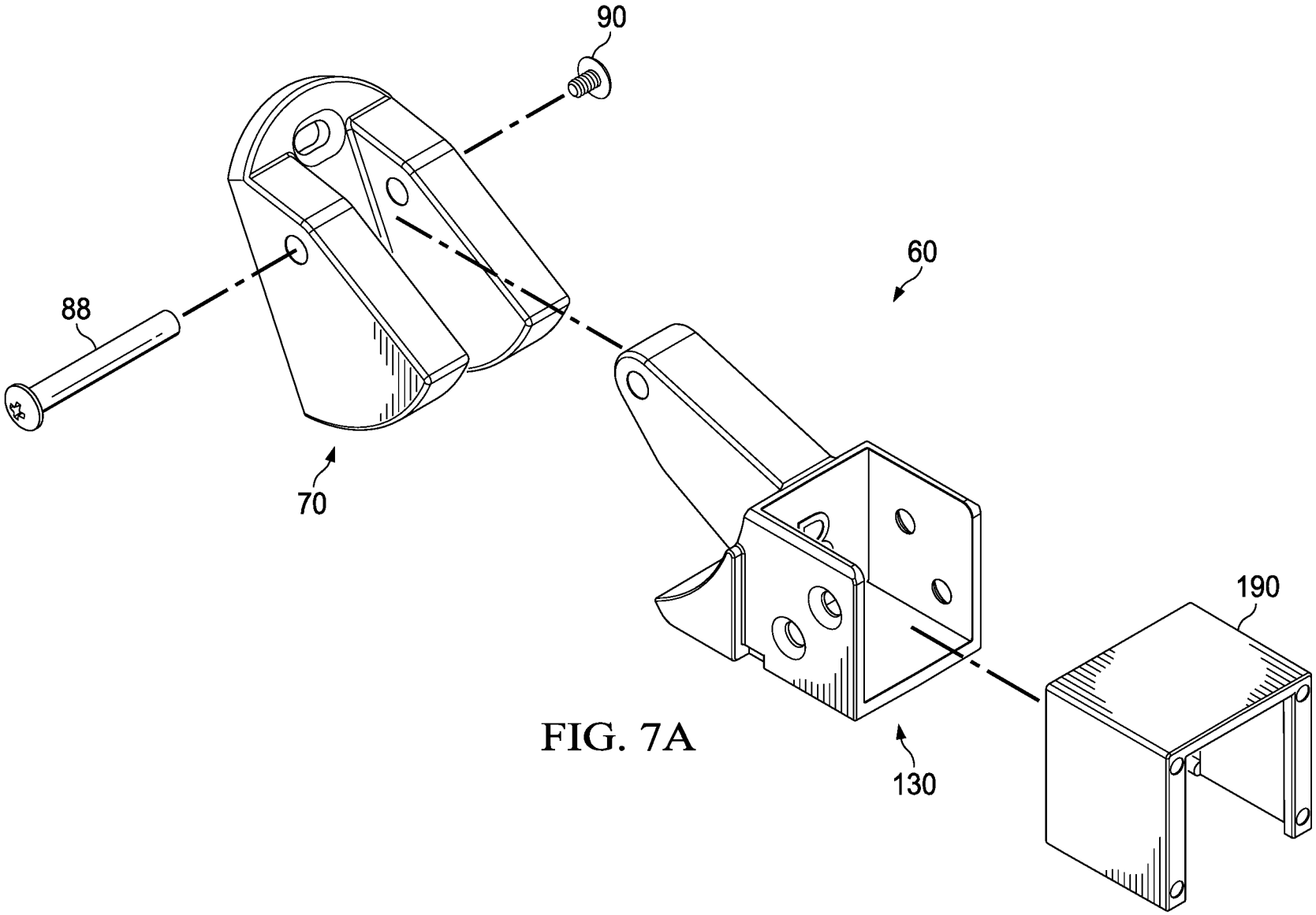
FIGS. 7A-7D illustrate embodiments of pivotable bracket assemblies used to support a raking rail panel according to the teachings of the present disclosure.
Figure 7B:
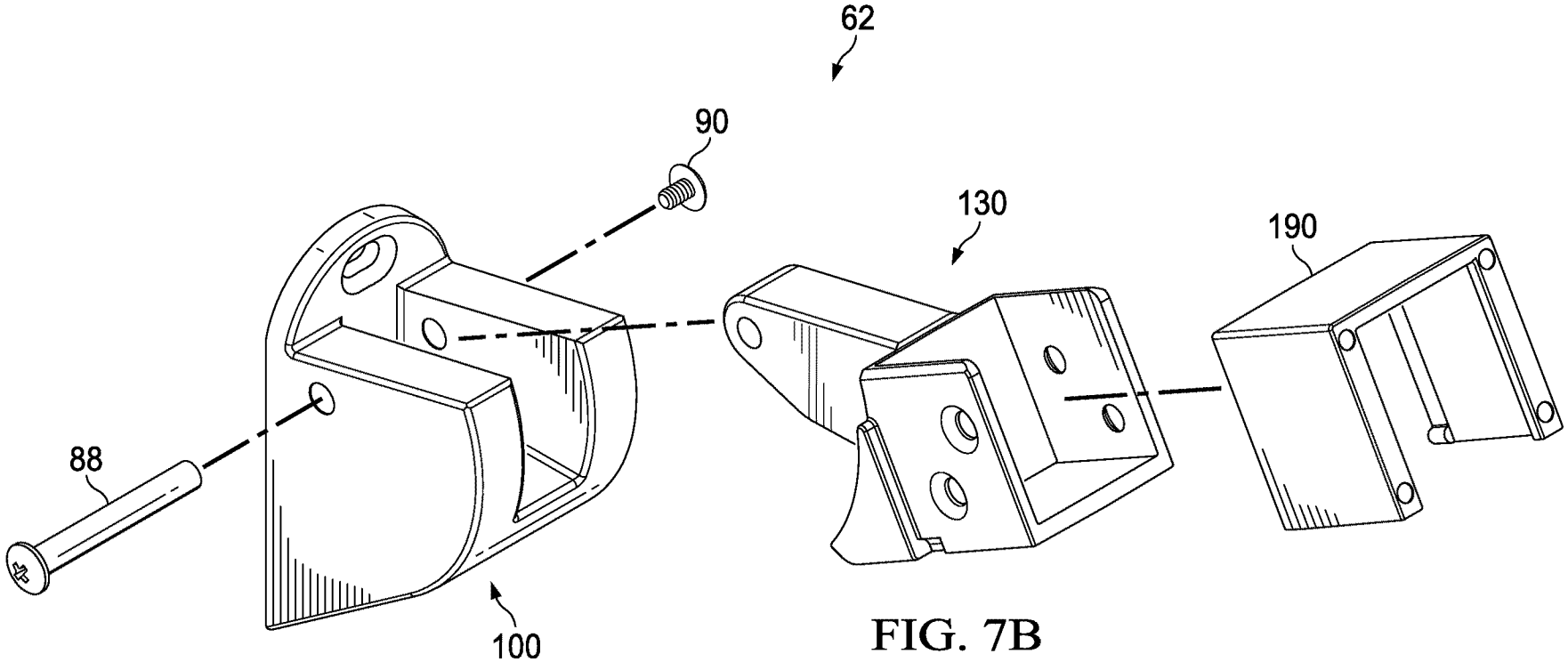
Figure 7C:
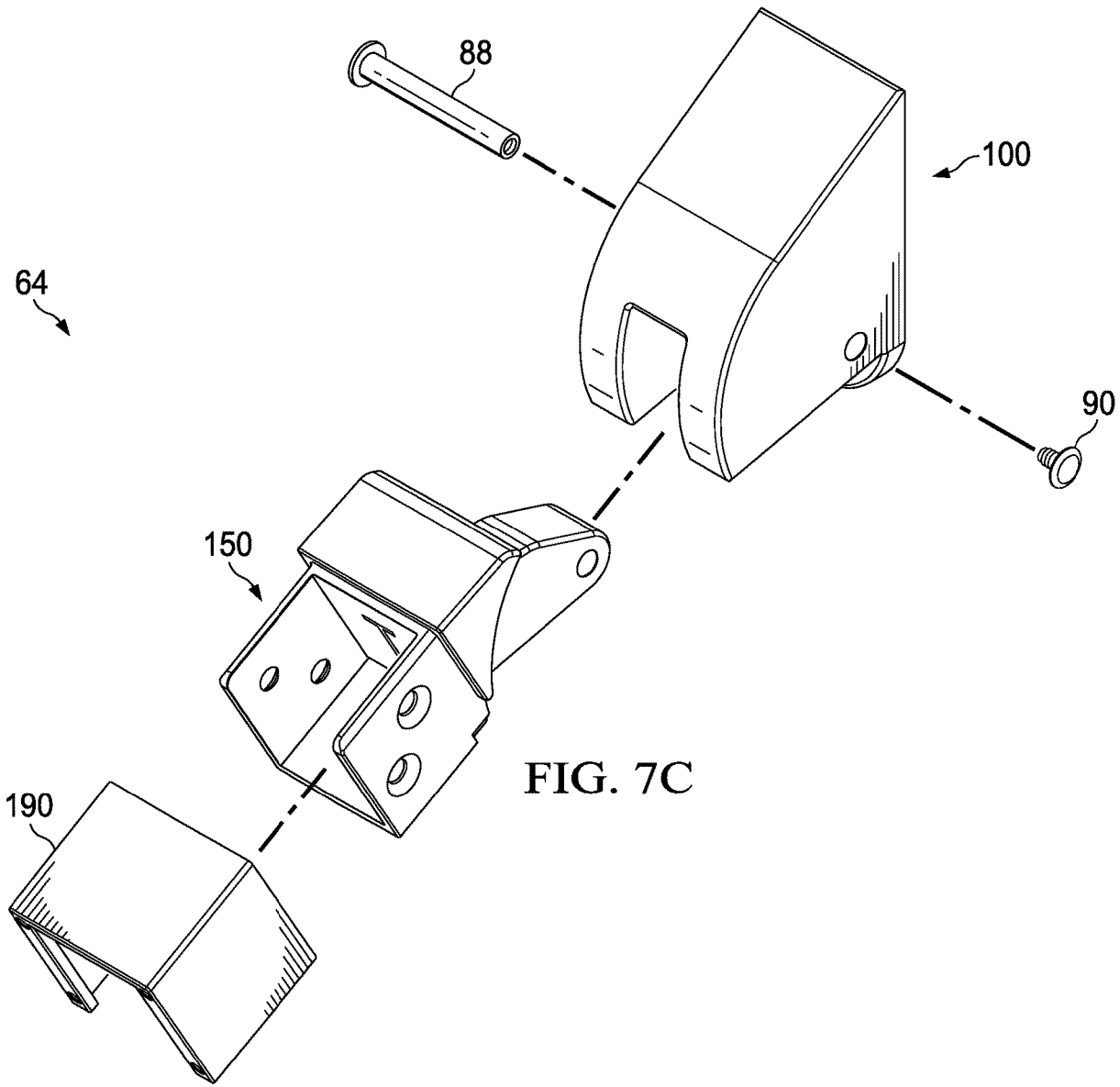
Figure 7D:
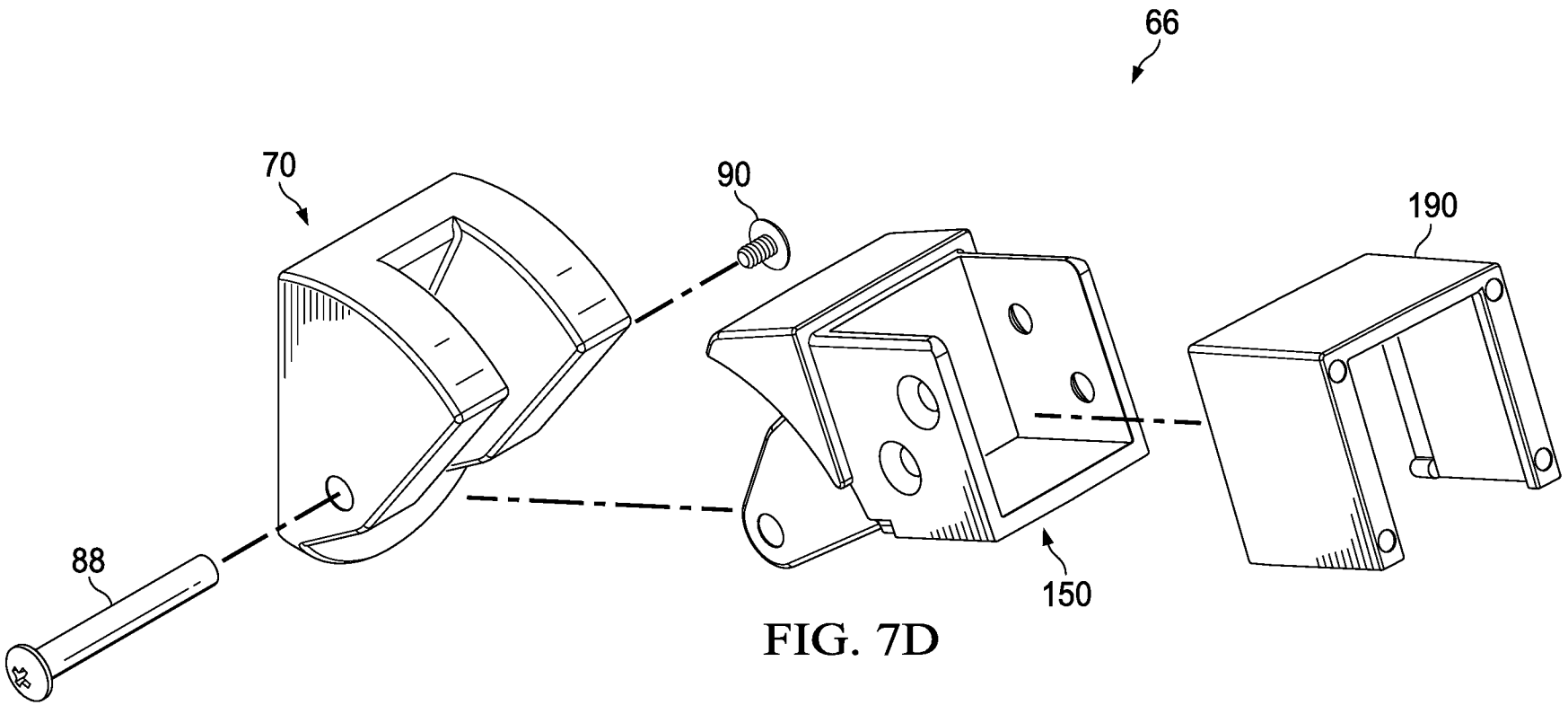

Reference is made to FIGS. 7A-7D along with FIG. 2, the pivotable bracket assemblies are coupled to the elevated and descended vertical support posts 50, 52 in position to hold the top rail 42 and bottom rail 44. FIG. 7A is an isometric, exploded view of the elevated, bottom assembly 60, which includes the short post bracket 70 hinged to the bottom rail support bracket 130, with the post mounting slot 76 of the short post bracket 70 oriented upward. FIG. 7B is an isometric, exploded view of the descended bottom assembly 62, which includes the extended post bracket 100 hinged to the bottom rail support bracket 130 with the post mounting slot 106 of the extended post bracket 100 oriented upward. FIG. 7C is an isometric, exploded view of the elevated, top assembly 64, which includes the extended post bracket 100 hinged to the top rail support bracket 150 with the post mounting slot 106 of the extended post bracket 100 oriented downward. FIG. 7D is an isometric, exploded view of the descended, top assembly 66, which includes the short post bracket 70 hinged to the top rail support bracket 150 with the post mounting slot 76 of the short post bracket 70 oriented downward.

The floor surfaces 136, 156 of each cup 132, 152 are disposed facing generally upward. The floor surfaces 136, 156, the rear walls 140, 160, and the side walls 138, 158 are open from the top to allow the installer to place the top and bottom rails 42, 44 in each of the four cups. The pivotability of the cups 132, 152 with respect to the vertical support posts and the post brackets 70, 100 allows virtually automatic adjustment to accommodate multiple slope angles. The is automatically accommodated without requiring angle cuts on the end of the rail, or offset cuts with respect to the top and bottom rails 42, 44. The system presents an aesthetically pleasing appearance at least in part because the gaps associated with the geometry of a raked rail panel are closed by the pivotable brackets 60, 62, 64, 66.

A measurement 169 is made at the rake angle θ from the rear wall 140 of the elevated, bottom assembly 60 to the rear wall 140 of the descended bottom assembly 62 is taken. This measurement 169 can be marked on the top rail 42 and the bottom rail 44. The top and bottom rails are marked to leave at least 1 and ⅜ inches of each of the top and bottom rails 42, 44 past the last picket or baluster 46 on both sides.

Figure 8:
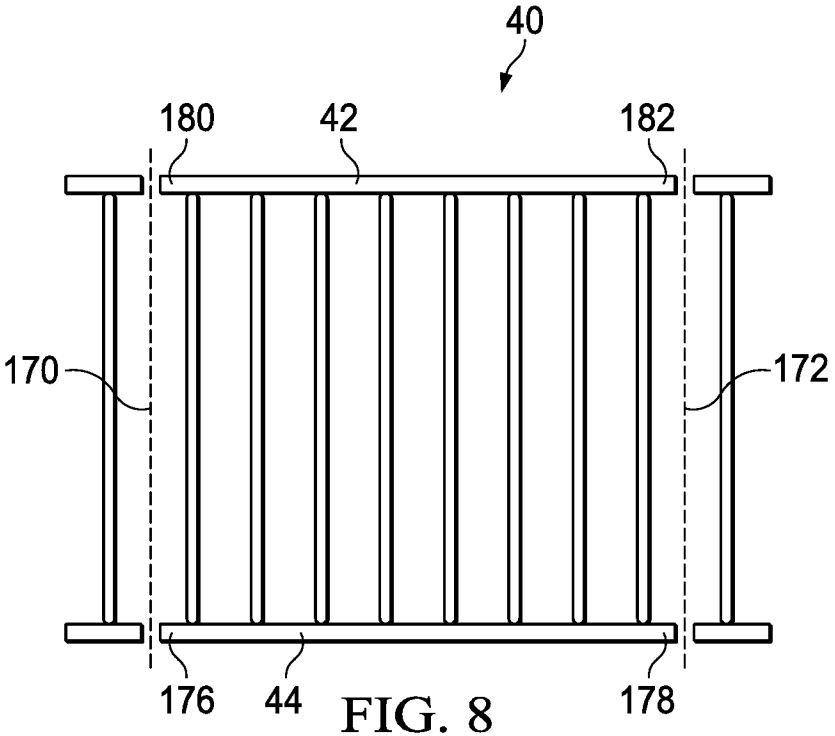
FIG. 8 illustrates a step in a process of installing a raking rail panel according to the teachings of the present disclosure.

Reference is made to FIG. 8, which illustrates the preassembled raking rail panel 40 in a straight, square orientation. Cutting lines 170, 172 are illustrated. Cutting along the cutting lines 170, 172 leaves rail extensions an equal distance from an adjacent baluster 46. In other words, a mountable rail end 176 of the bottom rail 44 is equal in distance to a mountable rail end 178 of the bottom rail 44 is equal in distance to a mountable rail end 180 of the top rail 42 is equal in distance to a mountable rail end 182 of the top rail 42. Thus, measuring and cutting the preassembled rail panel 40 for a specific installation is significantly simplified. In should be noted, that in certain rail panel installations, the raking rail panel in its original six or eight foot length may fit the installation, and therefore no cutting is required.

FIG. 9 illustrates the cut rail panel 40 in a raked configuration in position and held by the adjustable bracket assemblies 60, 62, 64, 66. Each of the balusters 46 is coupled to the top rail 42 at respective aligned pivot axes and to the bottom rail 44 at respective aligned pivot axes. Dropping-in the raked rail panel 40 is enabled because the pivot axis of the rail support brackets 130, 150 are aligned with the pivot axes of the balusters. Thus, pivoting of the adjustable bracket assemblies 60, 62, 64, 66 can be done simultaneous with pivoting of the raking rail panel 40. This enables virtually automatic pivot adjustment to accommodate the rake angle.

Upon placement of the top and bottom rails 42, 44 of the preassembled cut rail panel 40 into the cups 132, 152, fasteners are received through the countersunk holes in the side walls of the cups 132, 152. Self-taping metal screws are used to such that the screws engage the walls of the top and bottom rails 42, 44. Pilot holes may be drilled before screwing the self-taping screws. The countersunk holes may be used as guides for marking and or drilling the pilot holes.

FIGS. 7A-7D illustrate the caps 190 in an exploded view from the rail support brackets 130, 150. FIG. 9 illustrates the caps 190 snap-fit to the rail support brackets 130, 150 to cover the end of the top and bottom rails 42, 44. The caps 190 are fitted over the end of the top and bottom rails 42, 44 and over the cups 132, 152 to conceal the fasteners and complete the aesthetically pleasing rail panel with simplified manufacturing and installation according to the teachings of the present disclosure. The caps 190 snap fit to create flush surfaces with the extended post bracket 100 and the short post bracket 70 that appear continuous. An example cap or cover 190 is shown and described in U.S. Pat. No. 9,322,180, which is hereby incorporated by reference.

The cap 190 serves as a cover to hide the countersunk holes 142, 162 and screws received therethrough to secure the received end of the railing (not shown). The cap 190 accordingly provides an aesthetically pleasing finished railing assembly covering the included attachment hardware. The cap 190 is made of any suitable material including molded plastic or stamped sheet metal or a metal casting, such as aluminum. If made of stamped sheet metal, the stamped structure of the cap 190 comprises a generally elongate-shape that is folded along two lines to present three adjacent sides of a U-shaped structure.

The use of the cap 190 presents an installation with no visible fasteners. This also allows the cut ends of a railing, panel or other structure to be hidden along with the spaces that would exist between bracket and rails. The cap further has a "snap fit" assembly that locks securely in place with no need for fasteners, adhesive, welding or anything else. The cap can further be used from the top of the cup on installations without a wood top cap (over the railing) and from the bottom for installations with a wood top cap. When a cap 190 is applied to the cups 132, 152, an outer surface of the cap is flush with a wall of the arcuate surface support portions.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A raking rail panel system, comprising:

a raking rail panel comprising a top rail, a bottom rail, and a plurality of balusters pivotably coupled to the top rail and the bottom rail;

a first pivotable bracket assembly comprising:

a first post bracket configured to be coupled to an elevated vertical support post and having a first body comprising a first mounting surface and a first gap filling portion extending a first distance from the first mounting surface; and a first rail support bracket hingedly coupled to the first post bracket;

a second pivotable bracket assembly comprising:

a second post bracket configured to be coupled to a descended vertical support post and having a second body comprising a second mounting surface and a second gap filling portion extending a second distance from the second mounting surface, the second distance being greater than the first distance; and a second rail support bracket hingedly coupled to the second post bracket;

a third pivotable bracket assembly comprising:

a third post bracket configured to be coupled to the elevated vertical support post and having a third body comprising a third mounting surface and a third gap filling portion extending the second distance from the third mounting surface; and a third rail support bracket hingedly coupled to the third post bracket; and a fourth pivotable bracket assembly comprising:

a fourth post bracket configured to be coupled to the descended vertical support post and having a fourth body comprising a fourth mounting surface and a fourth gap filling portion extending the first distance from the fourth mounting surface; and a fourth rail support bracket hingedly coupled to the fourth post bracket.

2. The raking rail panel system of claim 1, wherein:

the first and fourth post brackets are sized and shaped the same;

the first and second rail support brackets are sized and shaped the same;

the second and third post brackets are sized and shaped the same; and the third and fourth rail support brackets are sized and shaped the same.

3. The raking rail panel system of claim 2, wherein:

each of the first and second rail support brackets include a pivot arm defining a distal through hole disposed above respective first and second floors and defining respective pivot axes; and each of the third and fourth rail support brackets include a pivot arm defining a distal through hole disposed below respective third and fourth floors and defining respective pivot axes.

4. The raking rail panel system of claim 1, wherein the first post bracket defines a first cavity and the first rail support bracket comprises a first pivot arm received within the first cavity;

the second post bracket defines a second cavity and the second rail support bracket comprises a second pivot arm received within the second cavity;

the third post bracket defines a third cavity and the third rail support bracket comprises a third pivot arm received within the third cavity; and the fourth post bracket defines a fourth cavity and the fourth rail support bracket comprises a fourth pivot arm received within the fourth cavity.

5. The raking rail panel system of claim 4, wherein:

the first rail support bracket comprises a first arcuate surface and the first pivot arm extending from the first arcuate surface;

the second rail support bracket comprises a second arcuate surface and the second pivot arm extending from the second arcuate surface;

the third rail support bracket comprises a third arcuate surface and the third pivot arm extending from the third arcuate surface; and the fourth rail support bracket comprises a fourth arcuate surface and the fourth pivot arm extends from the fourth arcuate surface.

6. The raking rail panel system of claim 4, wherein:

the first post bracket defines a first cavity floor of the first cavity and rotation of the first pivot arm is constrained by the first cavity floor;

the second post bracket defines a second cavity floor of the second cavity and rotation of the second pivot arm is constrained by the second cavity floor;

the third post bracket defines a third cavity floor of the third cavity and rotation of the third pivot arm is constrained by the third cavity floor; and the fourth post bracket defines a fourth cavity floor of the fourth cavity and rotation of the fourth pivot arm is constrained by the fourth cavity floor.

7. A raking rail panel system, comprising:

a raking rail panel comprising a top rail, a bottom rail, and a plurality of balusters pivotably coupled to the top rail and the bottom rail;

a first pivotable bracket assembly configured to couple to an elevated vertical support post and to support an elevated end of the bottom rail, the first pivotable bracket assembly comprising a first cup having a first floor and two first side walls, the first floor and the two first side walls configured to envelope the elevated end of the bottom rail;

a second pivotable bracket assembly configured to couple to a descended vertical support post and to support a descended end of the bottom rail, the second pivotable bracket assembly comprising a second cup having a second floor and two second side walls, the second floor and the two second side walls configured to envelope the descended end of the bottom rail;

a third pivotable bracket assembly configured to couple to the elevated vertical support post and to support an elevated end of the top rail, the third pivotable bracket assembly comprising a third cup having a third floor and two third side walls, the third floor and the two third side walls configured to envelope the elevated end of the top rail;

a fourth pivotable bracket assembly configured to couple to the descended vertical support post and to support a descended end of the top rail, the fourth pivotable bracket assembly comprising a fourth cup having a fourth floor and two fourth side walls, the fourth floor and the two fourth side walls configured to envelope a descended end of the top rail, wherein the first, second, third, and fourth floors are exposed to facilitate dropping in the raking rail panel raked at a non-perpendicular angle; and wherein each of the balusters are coupled to the top rail at a respective top baluster pivot axis and the third and fourth pivotable bracket assemblies each have a respective pivot axis in alignment with the top baluster pivot axes, and each of the balusters are coupled to the bottom rail at a respective bottom baluster pivot axis and the first and second pivotable bracket assemblies each have a respective pivot axis in alignment with the bottom baluster pivot axes.

8. The raking rail panel system of claim 7, wherein:

the first pivotable bracket assembly comprises a first gap filling portion having a first size to close a first gap;

the second pivotable bracket assembly comprising a second gap filling portion having a second size to close a second gap, the second size being larger than the first size;

the third pivotable bracket assembly comprising a third gap filling portion having the second size to close a third gap; and the fourth pivotable bracket assembly comprising a fourth gap filling portion having the first size to close a fourth gap.

9. The raking rail panel system of claim 7, wherein:

the first gap is between the elevated vertical support post and the elevated end of the bottom rail;

the second gap is between the descended vertical support post and the descended end of the bottom rail;

the third gap is between the elevated vertical support post and the elevated end of the top rail; and the fourth gap is between the descended vertical support post and the descended end of the top rail.

10. The raking rail panel system of claim 7, wherein the raking rail panel and the first, second, third, and fourth pivotable bracket assemblies are pivotable over a range of 29-40 degrees measured from horizontal.

11. The raking rail panel system of claim 7, wherein the first size includes an extension distance from a mounting surface in a range of 1.5-2.0 inches and the second size includes an extension distance from a mounting surface in a range of 2.0-2.5 inches.

12. The raking rail panel system of claim 11, wherein the extension distance of the first size is 1.77 inches and the extension distance of the second size is 2.28 inches.

13. The raking rail panel system of claim 7, wherein the raking rail panel comprises iron and the first, second, third, and fourth pivotable bracket assemblies each comprises aluminum.

14. The raking rail panel system of claim 7, wherein the raking rail panel is preassembled.

15. The raking rail panel system of claim 7, further comprising a plurality of caps each configured to cover a rail portion and a portion of respective pivotable bracket assemblies.

16. The raking rail panel system of claim 7, wherein the non-perpendicular rake angle is in a range of 29-40 degrees with respect to horizontal.

* * * * *